US005217374A

United States Patent [19]

Birks

[11] Patent Number: 5,217,374

[45] Date of Patent: Jun. 8, 1993

[54] ROLLER DRIVE SYSTEM FOR ROLLER HEARTH KILN

[75] Inventor: Charles H. Birks, McHenry, Ill.

[73] Assignee: Eisenmann Corporation, Crystal Lake, Ill.

[21] Appl. No.: 732,232

[22] Filed: Jul. 18, 1991

[51] Int. Cl.[5] ..... F27D 3/00

[52] U.S. Cl. ..... 432/236; 464/140; 34/121; 384/495

[58] Field of Search ..... 464/139, 140; 384/495–498; 432/236; 34/121

[56] References Cited

U.S. PATENT DOCUMENTS 1,272,740 7/1918 Wanders ..... 464/139
1,838,310 12/1931 Hubbel ..... 464/140
2,710,457 6/1955 Cirrito et al. ..... 34/121
2,914,864 12/1959 Clem ..... 34/121

FOREIGN PATENT DOCUMENTS 92677 8/1958 Norway ..... 34/121
231496 3/1925 United Kingdom ..... 384/495

*Primary Examiner*—A. Michael Chambers
*Attorney, Agent, or Firm*—Hill, Steadman & Simpson

[57] ABSTRACT

There is disclosed herein a drive system and a coupling system for each roller in a roller hearth kiln. The drive system is modular and encased and includes a plurality of aligned drive worms that engage driven gears that in turn rotate a drive shaft. The casing defines an oil sump which lubricates and cools the worm and gear and permits higher precision elements to be used. A cup-like ball-bearing style coupling system is used to drivingly couple the drive shaft to the roller.

11 Claims, 3 Drawing Sheets

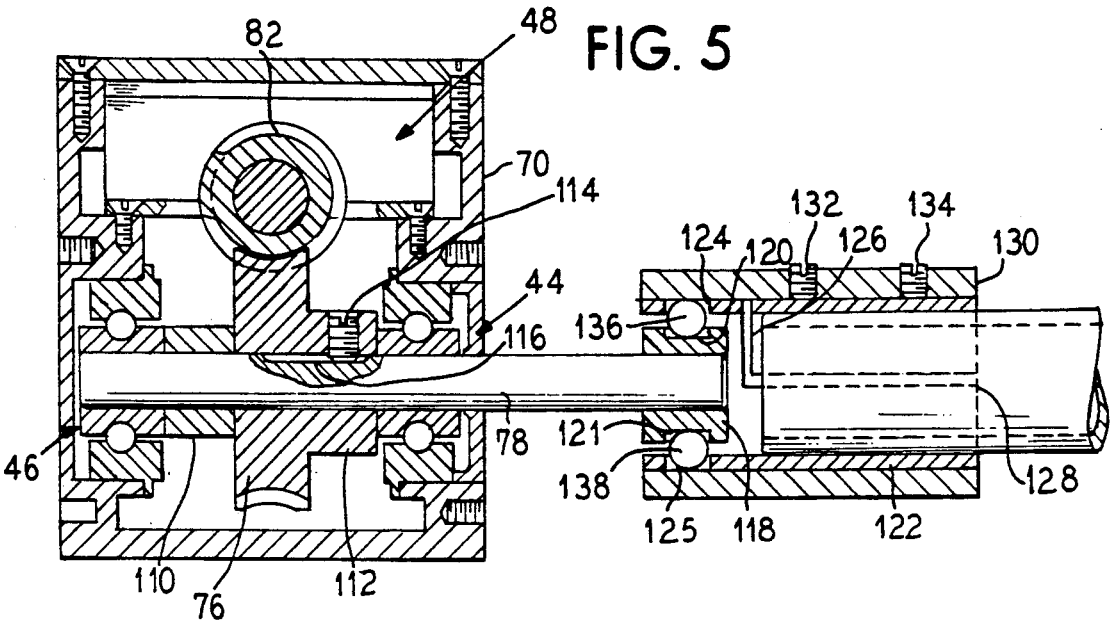
FIG. 5
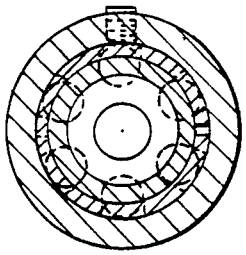
FIG. 6
FIG. 4B
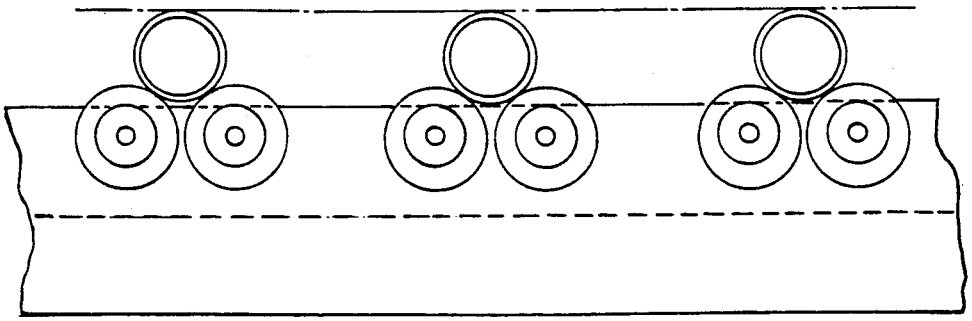

ROLLER DRIVE SYSTEM FOR ROLLER HEARTH KILN

BACKGROUND OF THE INVENTION

This invention relates to roller hearth kilns and in particular to mechanisms for supporting and driving rollers in the kilns.

A roller hearth kiln is used in both the ceramic and metallurgical industries and includes an elongated, tunnel-like insulated process chamber which has means for providing input of heat and movement of a process load therethrough. Typically the center third of the tunnel length but often as much as 70% of the length is heated. Product to be treated or fired is transported through the length of the process chamber on a conveyer system consisting of closely-spaced rollers, placed at 90° to the direction of travel. Rollers are normally made of high-temperature resistant materials, including various metal alloys, and a variety of high-strength ceramic materials. Ceramic rollers are the most common in the ceramic process industry.

A normal practice within the industry is to use rollers that are sufficiently long to extend through insulated sidewalls of the kiln, such that support of the rollers and the application of torque (driving force) can be accomplished outside the kiln and at the lower temperatures found there. Every roller kiln requires a drive system that performs the following functions:

1. Support of the rollers at both ends of each roller.
2. Retaining of the rollers within the system.
3. Reduction of turning friction of the rollers.
4. Imparting of torque to the rollers so that they may in turn convey the load.
5. Adjustment of roller level and perpendicularity relative to the direction of travel so as to provide tracking adjustment.

Within the industry a prime concern of customers relative to the roller hearth kiln is the function and serviceability of the roller and drive system as it is often the most difficult part of the process system to implement and normally requires more long-term maintenance and investment than all other components combined.

Two factors that affect those long-term costs are:

1. The rollers require periodic replacement due to breakage.
2. The drive system involves thousands of moving and wearing parts.

Thus one object of the invention includes effecting a smooth stress-free transfer of power to the rollers as such can greatly reduce roller replacement rates and even roll replacement costs due to drive shock and support system induced stress.

A further object of the system is to provide power distribution which is smooth so as to reduce mechanical issues and costs.

Current roller hearth kiln drives typically fall into two classes. The common system is to drive ceramic rollers using a coupling that employs a drive shaft that supports a drive cup for retaining a roller end and a steel cross pin or metal shaft that connects the cup and the roller. The drive shaft is supported by one or two bearings outside the kiln side walls. A sprocket is mounted on a shaft between the bearings and a chain of matching pitch is drawn over or under the sprockets to turn them. Various arrangements are used resulting in drive loops as short as five feet or as long as 100 feet. Problems inherent in this system include:

1. Chain stretch;
2. Stick slip behavior when the system is heavily loaded;
3. Poor tolerance for overrunning loads; and 4. High stress on bearings due to chain tensions required to overcome problems associated with numbers 2 and 3 above.

It is thus another object of this invention to minimize or eliminate the problems associated with a drive chain.

A commonly used alternative for roller driving involves a series of gears mounted on the roller shafts with counter or idler gears mounted therebetween so as to engage adjacent shaft gears and couple power from one roller to the next. As many as twenty shafts may need to be driven in a given section, resulting in forty gears and bearing sets in line and the first gear transmitting all the power required for every roll in the section. Thus a single broken tooth on any one of the first gears can result in the whole section stopping. Thus the load rating of the section must be carefully limited.

A further object of this invention is to minimize the problems which have occurred because of such a gear system.

Once the drive torque has been coupled to the bearing-mounted shaft, it still remains to effectively and safely couple that to the roller itself and to support the roller in a uniform and adjustable manner. A common usage is a system where the drive shaft has an integral cup and the cup is slightly larger than roller outside diameter and is provided with a transverse pin that engages a slot or notch machined into the roller. Support and retention of the roller is accomplished by a corresponding idler cup on the non-driven end of the roller which is mounted in a device similar to the drive assembly but without the drive sprocket or gear. A spring and collar or keeper arrangement keeps the idler cup firmly engaged to the roller and therefore the roller firmly engaging the drive cup. However, this system also has certain disadvantages. For example:

1. The cup by being slightly oversized from the roller may cause tumbling of the ceramic roller within the cup. Under load this may eventually result in breakage of the ceramic roller.
2. Removal of the roller requires complete disassembly of the idler cup, spring and bearing assemblies.
3. Since the cup is rigidly fixed to a shaft, there is little tolerance within the system for roll warpage or pressure, often resulting in shortened roller life. This problem then mandates low precision bearings within the support and drive system. Thus to run properly the system must be "sloppy".

Yet a further object of this invention is to provide a coupling system which avoids the disadvantages stated hereinbefore.

An alternative coupling and support system is used to provide a drive cup with some clamping means to affix it to the roller. The opposite end of the roller is then rested or supported on the opposite side in a notch or nip and between closely-spaced idler wheels or bearings. This system addresses problems listed hereinbefore but fails to address roller warpage, camber or loaded deflection.

Another factor which is believed to be critical is the fact that these kilns run at very high temperatures and thus the drive systems although outside the kiln are exposed to significant ambient temperatures.

It is thus desirable to maximize reliability of the drive bearing systems in such an application.

These and other objects of this invention will become apparent from the following disclosure and appended claims.

SUMMARY OF THE INVENTION

There is provided by this invention a drive system and a coupling system which minimizes the above-identified problems.

The drive system is modular in nature and includes a series of in-line gear-like worms that mesh with pinion-like worm gears mounted on roller drive shafts in order to drive rollers mounted thereto. Each drive system is in a casing and as such can be provided with oil, is lubricated in the manner of an oil sump, is thus cooled and may be of a precision nature. Appropriate provisions are made for bearings and floating of the drives to compensate for heat. In addition, the drives can be in pairs or sections so as to permit the separate driving of various sections.

The coupling system connects the drive output or the output of the pinion-like worm gear to the roller. This is a cup-like structure or constant velocity joint which includes a hub, drive bearing, a pair of sleeves, and an adjustment system for clamping the cup and the roller together.

BRIEF DESCRIPTION OF THE DRAWINGS

FIG. 4B is an alternative drive roller support and idler system;

FIG. 5 is a vertical sectional view taken along the side of a drive system showing the worm drive and roller connection;

FIG. 6 is an end view of the coupling system;

DESCRIPTION OF THE PREFERRED EMBODIMENT

Figure 1:
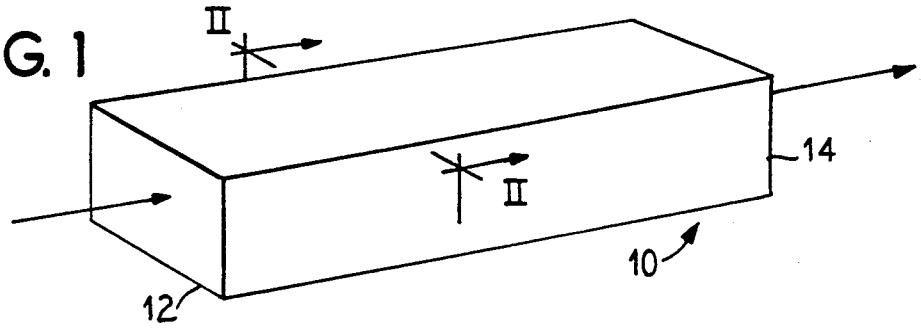
FIG. 1 is a diagrammatic perspective view of a roller hearth kiln.
Figure 2:
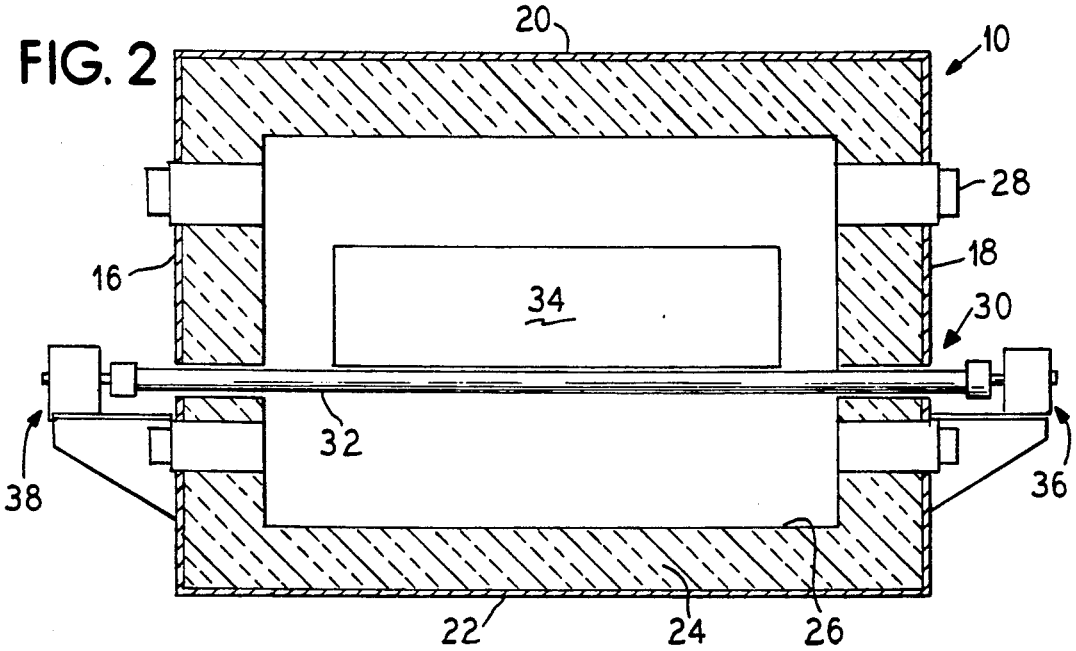
FIG. 2 is a vertical sectional view taken along line II—II of the roller hearth kiln.

Referring now to FIG. 1, there is shown in schematic form an elongated roller hearth kiln 10 generally which shows the elongated tunnel-like structure of the kiln and has an entry end 12 and an exit end 14. FIG. 2 is through the center of the kiln and the heat treatment zone of the kiln. However, it is to be understood that the structure hereinafter described fundamentally exists throughout the entire kiln.

Referring now to FIG. 2, the kiln 10 generally includes a pair of side walls 16 and 18, a ceiling 20 and a floor 22. Insulation 24 is provided about the wall, ceiling and floor and defines an inner chamber 26. Within the inner chamber and adjacent the ceiling along the length of the kiln, there are positioned gas burners, such as 28 (or electric heaters). Roller systems such as 30 are provided along the length of the kiln. A plurality of individual rollers such as 32 are provided along the length of the kiln to carry a load 34 through the kiln. The rollers extend transversely of the kiln, between the sides of the kiln and outwardly thereof. On one side is a roller support mechanism 36 and on the other side is a roller drive and support mechanism 38.

Figure 3:
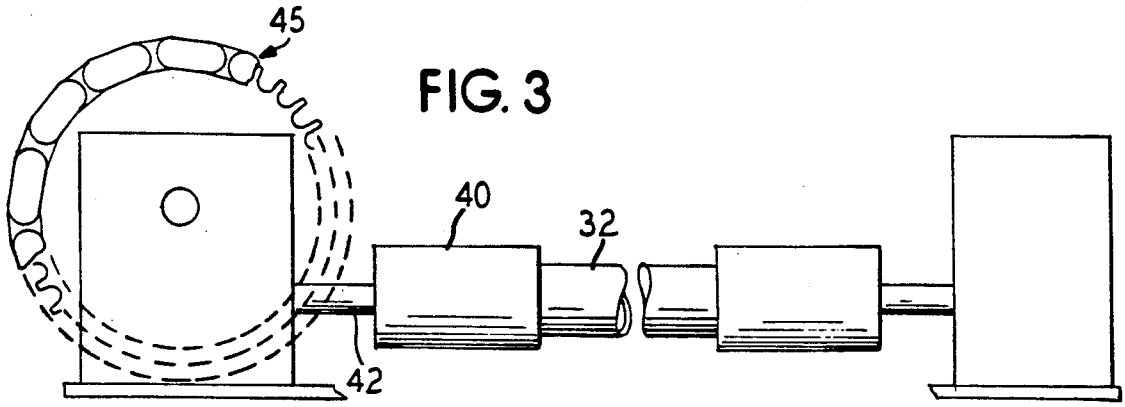
FIG. 3 is an enlarged diagrammatic vertical sectional view showing a system for connecting the roller to the drive shaft.

The roller support and drive is shown in schematic form in FIG. 3 and includes the roller 32 which engages a cup-like member 40 which is mounted to a drive shaft 42 that extends between a pair of bearings 44 and 46 positioned outside the kiln and a drive mechanism 48. The drive mechanism rotates the shaft 42, which in turn turns the cup or coupling member 40, which in turn rotates the roller 32.

Figure 4A:
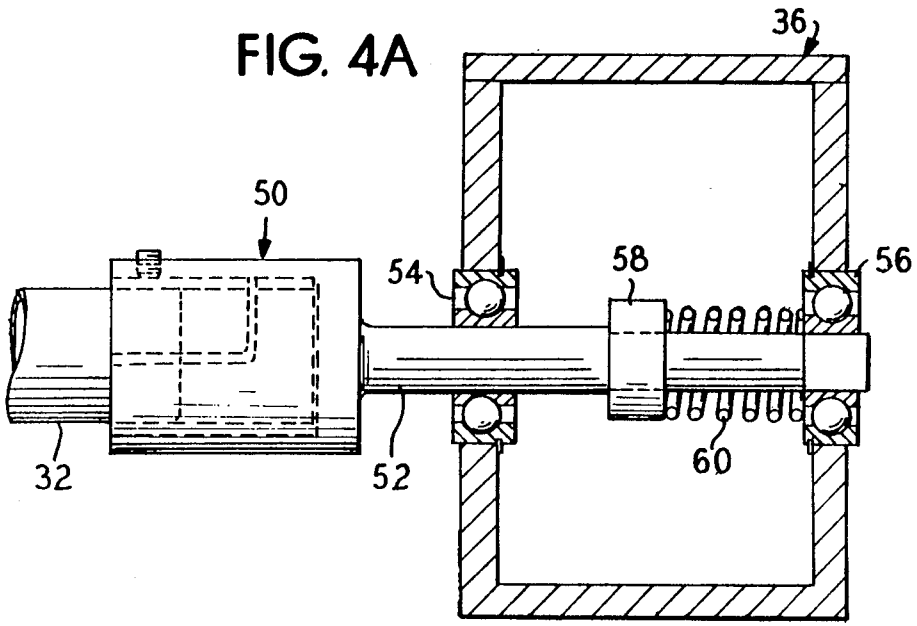
FIG. 4A is an idler system wherein the rollers are attached to the other side of the kiln and spring-loaded.
Figure 8:
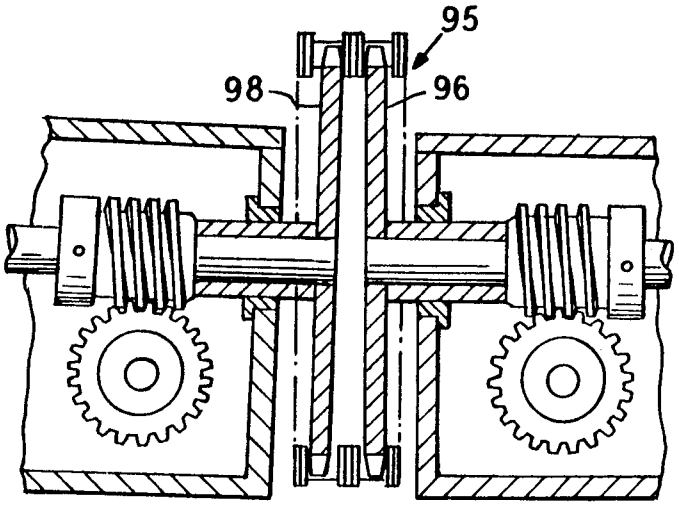
FIG. 8 is an enlarged view of the drive connection between a pair of drive sections.

At the other side of the roller, there is the roller support device 36 such as shown in FIG. 4A. The device 36 includes a cup or coupling 50 for engaging the roller 32. The cup is mounted (as by welding) to a shaft 52 which extends between the two bearings 54 and 56 located outside the kiln. A collar or spring keeper 58 is mounted on the shaft 52 and a compression spring 60 is positioned between the outboard bearing 56 and a spring keeper 58 and urges the shaft 52 and cup toward the roller. This spring keeper assembly urges the shaft 52 and the cup 50 into engagement with the roller 32 and urges the roller into engagement with the cup 40 and drive shaft 42.

Figure 7:
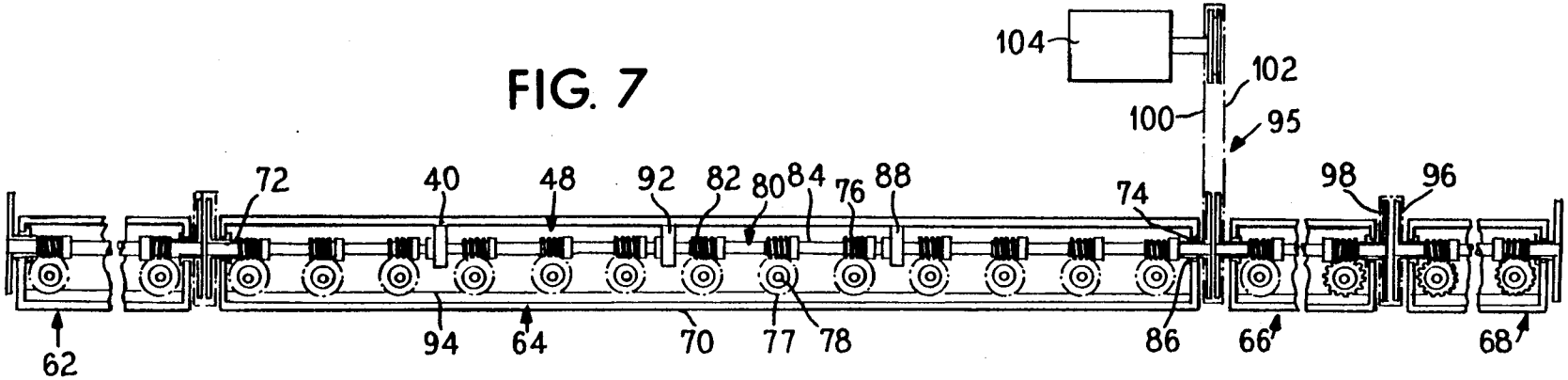
FIG. 7 is a vertical sectional view taken through the side of drive units.

Turning more specifically to the roller drive, reference is made to FIG. 7. In FIG. 7 four drive sections 62, 64, 66 and 68 are shown. Drive section 64 is typical.

Each drive section includes a casing such as 70 which surrounds the drive assembly as described hereinafter. The casing is, in effect, a hollow metal structure (e.g., an enclosed channel-like member) and if appropriate may be extruded. The ends of the casing are provided with bearing systems that define end openings 72 and 74. Each of the casings encase thirteen gear-like worms such as 76. Each worm engages a worm gear such as 77 that is mounted to or secured to each output shaft such as 78, which in turn is secured to a roller. The worm gears are driven by an aligned worm assembly 80, which include worm members such as 76 and 82. Each of the worm members such as 82 is axially aligned with and secured to a worm drive shaft such as 84. The shaft to which the worms are mounted is secured to the casing at the end openings by bushing members such as 86 and by a pair of thrust bearings 88 and 90 and a radial bearing 92. Thus rotation of the drive shaft 80 rotates each of the worms and thus the respective gears. Failure of one gear by loss of a tooth, etc., will not significantly impinge on the power distribution or rotation of the other gears.

Since the drive system is encased, the lower portion of the casing can act as an oil sump and lubricating oil such as 94 can be fed to the casing so as to lubricate the gears which in turn carry lubricating oil to the worm, shaft and bearings.

Power distribution chains such as 95 engage one or two sprocket gears such as 96 and 98 as shown with respect to sections 66 and 68. Thus the power distribution to each of the two drive sections can be in effect separate. Thus a single drive chain can rotate those two sprockets or two drive chains can be used which are either synchronously or asynchronously rotated so as to achieve different rotation of the sprockets and thus different rotation of the rollers. Moreover, this connection can accommodate some misalignment. A double chain is shown as 100 and 102, respectively, driving the aligned shafts in sections 64 and 66. A drive 104 is provided for driving the drive chain. The use of an oil bath to lubricate the gears results in cooler operation of the gears and permits more precise gear and bearing systems.

It has been found that the modular units are normally close to sixty inches long or one and one-half meters but may be longer or shorter. Normally the drive case includes between ten and thirty sets of output shafts. Thermal expansion of the aligned shaft is accommodated by a floating sprocket bushing. This is critical due to the high ambient temperature encountered in the vicinity of the kiln.

THE DRIVE CUP ASSEMBLY

Referring now to FIG. 5, a vertical cross-sectional view of the drive section is shown. There is shown the casing 70 within which there is positioned the drive worm 82 which drives a gear such as 76. The gear is mounted on an output shaft such as 78. The output shaft is journalled to the housing 70 by bearing systems 44 and 46.

The worm gear is positioned on the shaft 78 and is held in position by a spacer 110 at one end of the shaft and a locking collar or hub 112 which is between the inboard bearing 44 and the gear 76. The locking collar includes an adjustment screw 114 that engages a keyway 116 in the output shaft. Thus power from the worm 82 is transmitted to the gear 76 and to the output shaft 78. The inboard end of the output shaft has mounted or welded thereto a hub 118 that includes a plurality of radial indentations, such as 120 and 121, along its circumference. These indentations are used for driving purposes described hereinafter.

The coupling also includes a tubular-like inner sleeve 122 that also includes at one end a plurality of drive indentations or openings 124 and 125. At the other end, the inner sleeve has adjustment slots such as 126 and 128 that are cut axially and circumferentially into the inner sleeve. Positioned about the inner sleeve is an outer sleeve 130 which also includes a pair of adjustment screws such as 132 and 134 that are constructed to engage the inner sleeve and compress it about the adjustment slots.

Ball bearings such as 136 and 138 are positioned in the hub drive indentations such as 118 and the sleeve drive indentations such as 124 so as to transmit torque from the hub to the sleeve. It is noted that the ball bearings are spherical and take up some angular displacement of the sleeve's longitudinal axis relative to the output shaft's longitudinal axis.

In terms of assembly the inner sleeve is first positioned over the drive hub, the drive ball bearings are positioned in the inner sleeve and drive hub, and then the outer sleeve is slid thereover so as to trap the drive ball bearings in position.

In order to hold the roller end, the roller end is inserted or slid into the open end of the coupling sleeve toward the drive hub. Then the adjustment screws 132 and 134 are tightened so as to press the flexible portion of the inner sleeve against the roller end and hold the roller end in position. A similar operation can be conducted on the other roller end. The clamp firmly retains the roller, eliminating any possibility of tumbling, and thus damage to the roller end. Moreover, the hub and balls serve to support the sleeve and cup concentric to the powered shaft while allowing small amounts of angular displacement such as created when rotating a warped or cambered roller, once the roller has been deflected due to application of a load, or by intentionally misaligning of the drive and idler supports for conveyer tracking purposes. This cup can be used in pairs on both ends of the roller or with the idler side of the roller supported in the nip of wheels as described before.

Although the invention has been described with respect to preferred embodiments, it is not to be so limited as changes and modifications can be made which are within the full intended scope of the invention as defined by the appended claims.

I claim as my invention:

1. A roller drive system for use in a high temperature roller hearth kiln of the type used in treating ceramic materials which includes a plurality of transversely positioned rollers spaced along the length of the kiln and extending sideways of the kiln for engagement with said drive system wherein:

said drive means are provided external of the kiln in a plurality of modular elongated units for engagement with the rollers;

each unit is encased, elongated, and includes a pair of ends, and is constructed to cause a plurality of rollers to rotate and each unit includes:

a plurality of pinion-like worm gears, each for coupling to a roller; and a worm assembly which extends between the ends of the unit and includes:

an elongated drive shaft; and a plurality of worm-like members each member mounted to said drive shaft so that said worm-like members are axially aligned with each other and coupled to said drive shaft for rotation and each worm-like member is constructed to engage a pinion-like worm gear;

the worm-like assembly being mounted above the pinion-like worm gears;

whereby said plurality of rollers are rotated.

2. A roller drive system as in claim 1, wherein said drive shaft extends from one end of the casing to the other and is journalled to said casing.

3. A roller drive system as in claim 2, which further includes bearing means for use in journalling said drive shaft.

4. A roller drive system as in claim 2, wherein there is provided in association with the drive shaft floating bushing means for accommodating thermal expansion of the worm assembly.

5. A roller drive system as in claim 1, wherein each unit defines an oil sump in its lower portion into which at least a portion of each pinion-like worm gear can extend and which is substantially leak-free.

6. A roller drive system as in claim 1, wherein each modular casing includes an extruded body member.

7. A roller drive system as in claim 1, wherein each of the pinon-like worm gears is mounted to the casing and said mounting includes an externally positioned oil seal.

8. A roller drive system as in claim 1 which includes a plurality of modular units coupled to each other for operation.

9. A coupling system for use in a high temperature roller hearth kiln of the type used in treating ceramic materials which includes transversely positioned rollers that are spaced along the length of the kiln, each of which extends transverse of the kiln for engagement with a roller drive or support system, which coupling system includes at least one coupling assembly for driving a roller, said assembly including;

output shaft means having one end for rotatable engagement with drive means, and the other end including a drive hub mounted thereon and having a plurality of drive indentations spaced around the circumference of the hub;

a cylindrical and tubular coupling sleeve for receiving and engaging a roller and the hub sleeve, said coupling having an inner and outer sleeve, said inner sleeve having drive indentations at one end corresponding to the hub drive indentations and constructed to snugly and tightly engage a roller and the outer sleeve surrounds and tightly engages the inner sleeve;

securement means associated with the inner and outer sleeve for securing said sleeves to a roller; and transmission means for interfitting with the hub and sleeve indentations to couple the sleeve to the hub for the transfer of power and movement between the hub to the inner and outer sleeve and the roller.

10. A coupling system as in claim 9, wherein:

said inner sleeve includes a pair of adjustment slots including longitudinal slot in the wall of the sleeve and an interacting circumferential slot; and said outer sleeve includes threaded adjustment screws opening and there is further provided a threaded adjustment screws for engagement with said openings and said inner sleeve to urge said inner sleeve against a roller and thereby tighten said coupler onto said roller.

11. A coupling system as in claim 10, wherein said transmission means includes ball bearing-like members for positioning in said indentations, which is axially elongated so as to permit limited axial movement of the ball-like members therein.

* * * * *